US008261835B2

(12) United States Patent
Plunkett et al.

(10) Patent No.: US 8,261,835 B2
(45) Date of Patent: Sep. 11, 2012

(54) DUAL ACTING ROD PISTON CONTROL SYSTEM

(75) Inventors: Kevin R. Plunkett, Broken Arrow, OK (US); John D. Lindemann, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 368 days.

(21) Appl. No.: 12/481,740

(22) Filed: Jun. 10, 2009

(65) Prior Publication Data

US 2010/0314120 A1 Dec. 16, 2010

(51) Int. Cl.
*E21B 34/10* (2006.01)

(52) U.S. Cl. ..... 166/319; 166/386; 166/332.3; 166/375; 251/62

(58) Field of Classification Search ..... 166/386, 166/321, 329, 332.3, 334.2, 375, 319; 251/62, 251/12

See application file for complete search history.

(56) References Cited

U.S. PATENT DOCUMENTS

| | | | | |
|---|---|---|---|---|
| 1,742,802 | A * | 1/1930 | Bergquist | 417/131 |
| 2,785,755 | A * | 3/1957 | En Dean | 166/72 |
| 3,747,618 | A * | 7/1973 | Boes | 137/80 |
| 3,886,967 | A | 6/1975 | Nelson | |
| 4,161,219 | A * | 7/1979 | Pringle | 166/324 |
| 4,429,620 | A * | 2/1984 | Burkhardt et al. | 91/395 |
| 4,467,870 | A | 8/1984 | Langham | |
| RE32,390 | E * | 4/1987 | Pringle | 166/321 |
| 4,907,650 | A | 3/1990 | Heinonen | |
| 6,173,785 | B1 | 1/2001 | Adams et al. | |
| 6,308,783 | B2 | 10/2001 | Pringle et al. | |
| 6,513,594 | B1 | 2/2003 | McCalvin et al. | |
| 6,691,785 | B2 | 2/2004 | Patel | |
| 6,957,703 | B2 | 10/2005 | Trott et al. | |
| 7,032,672 | B2 | 4/2006 | Dennistoun et al. | |
| 7,314,091 | B2 | 1/2008 | Wagner et al. | |
| 7,347,270 | B2 | 3/2008 | McMillan et al. | |
| 2003/0192687 | A1 * | 10/2003 | Goodson et al. | 166/65.1 |
| 2005/0279496 | A1 * | 12/2005 | Fontenot et al. | 166/250.1 |
| 2008/0110632 | A1 | 5/2008 | Beall | |
| 2008/0223581 | A1 | 9/2008 | Beall et al. | |
| 2008/0314599 | A1 | 12/2008 | Bane et al. | |
| 2009/0056948 | A1 | 3/2009 | Martin et al. | |

OTHER PUBLICATIONS

Sloan, Jim, et al., "Safety Valve for Ultradeepwater Lower Tertiary Applications", SPE 134597, Sep. 1-9, 2010.

Sloan, Jim, et al., "Safety Valve for Ultradeepwater Applications", SPE 136867, Oct. 1-9, 2010.

* cited by examiner

*Primary Examiner* — Kenneth L Thompson
(74) *Attorney, Agent, or Firm* — Steve Rosenblatt

(57) ABSTRACT

A downhole tool is hydraulically actuated through a control system that features rod piston(s) that are double acting. The piston bore is in a single housing component with an annular cavity that provides access to all piston bores to move the pistons in a first direction. The housing component that has the piston bore also includes an internal sleeve in a passage in the housing. A second control system connection communicates with a sealed annular space defined between the sleeve and the passage wall that holds the sleeve. A series of radial ports communicate from the annular space into each piston bore on the opposite side of each piston from the annular cavity so that each piston is double acting with a bore in a single housing component.

16 Claims, 4 Drawing Sheets

DUAL ACTING ROD PISTON CONTROL SYSTEM

FIELD OF THE INVENTION

The field of the invention is subterranean hydraulic pressure control systems for tools and more particularly control systems using rod pistons which are double acting for shortening overall tool length.

BACKGROUND OF THE INVENTION

On many occasions tools that are located far underground such as in a wellbore need to be operated at predetermined times from the surface. This is typically accomplished by running small hydraulic lines adjacent a producing tubing string and connecting the lines to one or more operating pistons that are in turn connected to a movable component in the tool. In the case of a downhole isolation valve, for example, the valve can be selectively operated between an open and a closed position from the surface. Options are possible such as for chokes where intermediate positions are also possible between fully open and fully closed.

There are numerous design criteria that affect the design of a control system for a particular application. In most applications space is at a premium in a downhole location and the more space allotted to the control system the less space remains for a through passage in the tool such as a valve. There are also issues of overall tool length as well as a choice between using an annular piston or one or more rod pistons. While certain options address some criteria favorably, they also create issues in other criteria that makes such an option more expensive or in some cases impractical. For example, an annular piston can be used in a downhole valve that can be fairly short and double acting as illustrated in US Publication 2008/0110632. The problem is that the annular piston 26 takes up a lot of space and makes the use of rod piston(s) more practical. Annular pistons experience large seal friction due to the size of the seals that are associated with them. Rod pistons have very small seals and correspondingly less seal friction that has to be overcome with the hydraulic system.

One way to employ rod pistons is in opposed pairs where each bank of rod pistons is single acting. It is important to keep in mind that it is undesirable to have manifolds of control lines on the exterior of a tool housing to reach individual rod piston chambers. What is frequently done is that two housing components are designed to create an annular chamber that communicates with one side of a bank of rod pistons. To enable reverse motion, another bank of rod pistons is oppositely oriented with its own control line connection so that depending on which control line is pressurized, the downhole tool component is urged to move in opposite directions. In an improvement to the design of US Publication 2008/0110632 the annular piston 26 was replaced with pairs of opposed rod pistons as described in U.S. application Ser. No. 12/054,809 filed Mar. 25, 2008. FIG. 1 illustrates a simplified version of the control system used in that application to facilitate understanding of the present invention.

In an application for turning a ball 90 degrees between and open and a closed position, there was shown in that application a shifting slide that engages the turning ball in an offset manner where the ball was pinned for rotation about its center. As shown in FIG. 1, the ball 10 is connected off center at 12 by a shifting slide 14. The ball 10 is also pinned about its center for rotation and that connection is not shown to make the drawing more simple. An annular chamber 16 is formed as threads 18 and 20 are made up to connect components 22 and 24. A control line connection 26 directs fluid pressure into chamber 16 and from there to the individual rod piston bores such as 28 and 30. Pistons such as 32 and 34 each have piston seals such as 36 and 38 such that pressure applied at control line connection 26 will shift all the upper rod pistons such as 32 and 34 in tandem. Since all the pistons such as 32 and 34 are connected to the slide 14, actuating the upper rod pistons turns the ball 10 90 degrees. There is also provided a mirror image array of lower pistons 40 and 42 connected on an opposite end of the slide 14 and is actuated to move in the opposite direction as pistons 32 and 34 when hydraulic pressure is applied at connection 44 that leads into an annular chamber 46 that communicates with all the piston bores such as 48 and 50. Since the pistons 40 and 42 have seals 52 and 54 pressure applied at connection 44 results in opposed ball 10 movement than pressure applied at connection 26.

One issue with this design is that it makes the overall tool length very long because there are duplicated sets of opposed pistons that are single acting, while being disposed end to end for design simplicity and to avoid wasting space that is needed by other components.

The problem with trying to make rod pistons double acting is illustrated in FIG. 2. Solving this problem is one of the objectives of the present invention. Before going into the details of why the FIG. 2 design is a problem it is important to again emphasize that external manifolds of control lines that access every rod piston bore from the outside of the tool housing are frowned upon because they can very easily be bent, damaged or even sheared off when running the tool to the desired position downhole through surrounding tubulars with minimal clearance. To make rod pistons double acting before the present invention was developed, the standard thinking was that there would need to be another housing connection that could define a second annular chamber as shown in FIG. 2. This meant that the piston bore would straddle two threaded components. The problem that arises from such a design is that there is no reliable way to ensure that the portions in a single piston bore in two abutting housing pieces create a second annular chamber that would in fact be in alignment so that the piston would not get into a bind. FIG. 2 illustrates this problem. As before there is an upper annular chamber 16' made by threads of adjoining housing pieces 22' and 24'. However, to create a second annular chamber 56 a new housing component 58 will have to be connected to component 22' at threads 60 and 62. To make such a design work the upper portion of the piston bore 64 in component 22' would have to perfectly align with the lower portion of the piston bore 66 in component 58. Of course, an additional fixed seal such as 68 and 70 through which a respective rod piston reciprocates would need to be added to each piston as well as an exterior connection for a control line into the chamber 56 to make the system double acting.

Thus the problem solved by the present invention is presented. How can a rod piston design be double acting without requiring another housing connection for an annular chamber that communicates to all the rod piston bores on the other side of a piston seal from control line connection 26' so as to avoid the issue of piston bore alignment described with regard to FIG. 2. The present invention manages to provide access to the same rod piston bores on the opposite side of piston seals internally without needing another housing component so as to make moot the issue of bore alignment. Those skilled in the art will better understand the invention from the description of the preferred embodiment and the associated drawings while understanding that the full scope of the invention is given by the appended claims. While the preferred embodiment is focused on a downhole isolation valve to illustrate the concept it will be recognized that a wide variety of other tools that are operated with hydraulic control lines can also benefit from the present invention.

SUMMARY OF THE INVENTION

A downhole tool is hydraulically actuated through a control system that features rod piston(s) that are double acting. The piston bore is in a single housing component with an annular cavity to provide access to all piston bores to move the pistons in a first direction. The housing component that has the piston bore also includes an internal sleeve in a passage in the housing. A second control system connection communicates with a sealed annular space defined between the sleeve and the housing wall that holds the sleeve. A series of radial ports communicate from the annular space into each piston bore on the opposite side of each piston seal from the annular cavity so that each piston is double acting with a bore in a single housing component.

DETAILED DESCRIPTION OF THE PREFERRED EMBODIMENT

Figure 3:
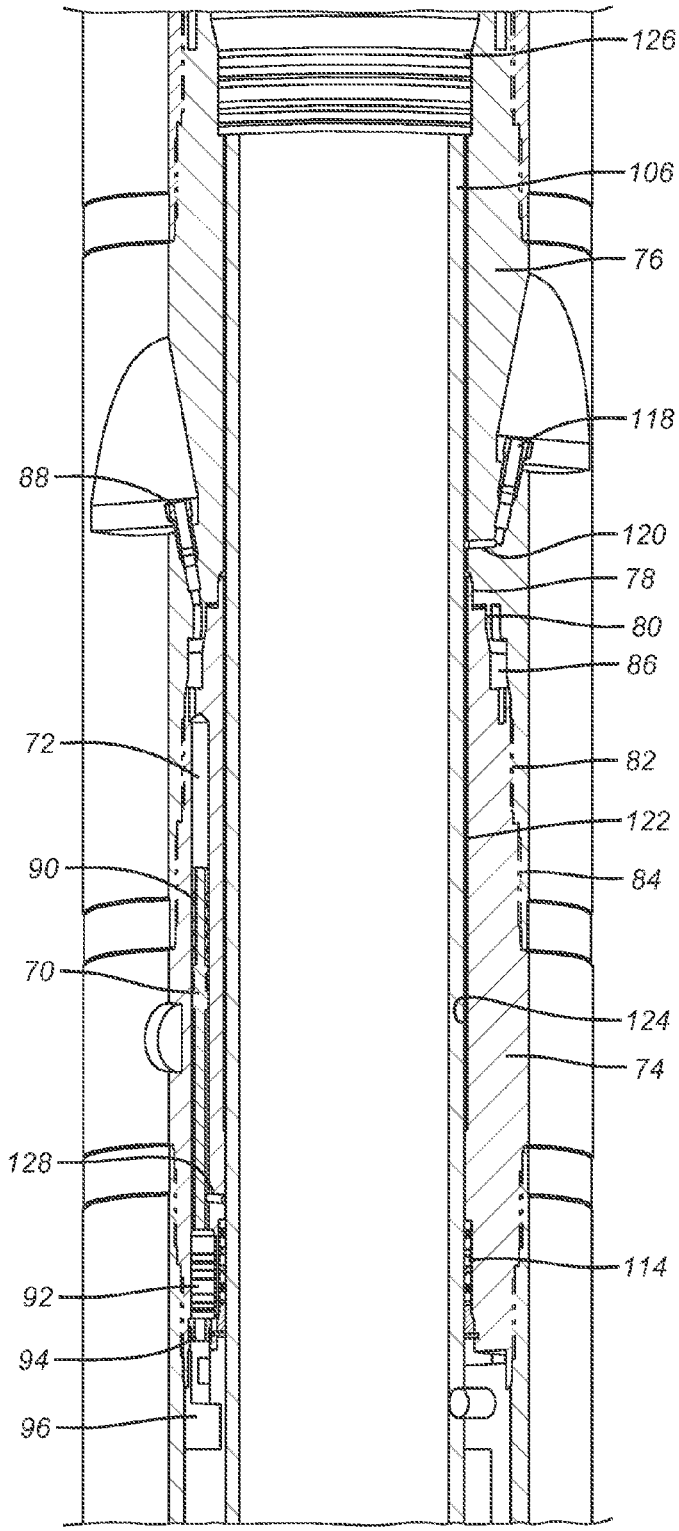
FIG. 3 is a close up view showing how the rod pistons are made double acting with a piston bore in a single housing component to avoid the alignment issues shown in FIG. 2.
Figure 4:
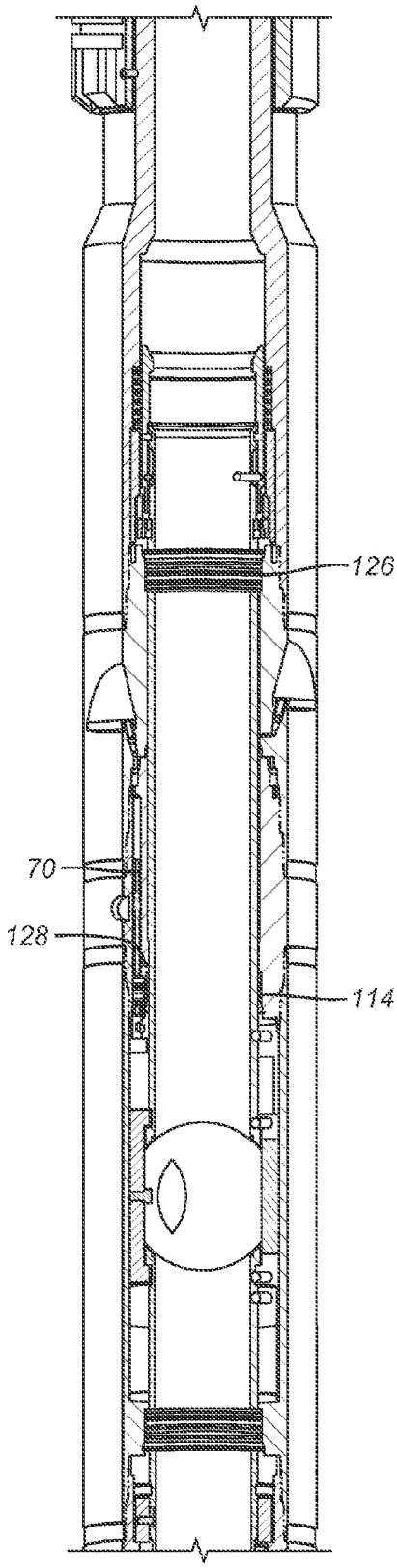
FIG. 4 is the view of FIG. 3 showing how the control system is integrated with a downhole isolation valve as one possible application.
Figure 6:
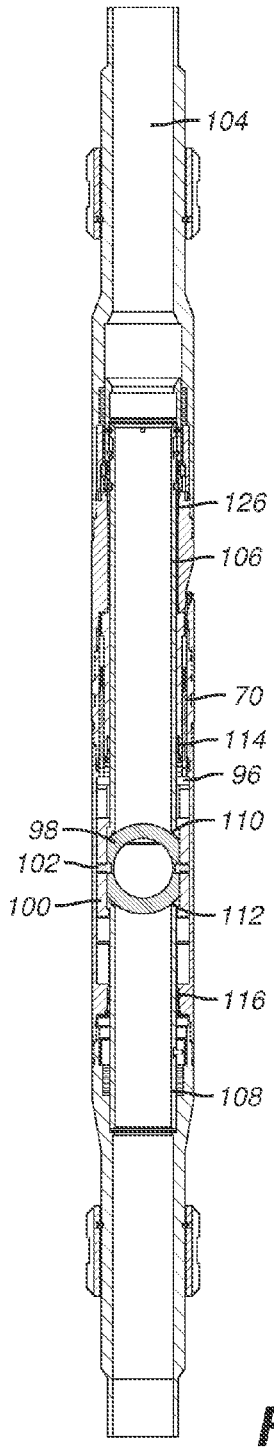
FIG. 6 is what a downhole isolation valve of FIG. 5 would look like with the double acting rod pistons and is used to show the length decrease in the tool made possible from use of the double acting rod pistons.

FIG. 3 shows one of several pistons 70 each disposed in a discrete bore 72 where the entirety of the bore 72 extends in a single housing piece 74. An upper housing component 76 is connected to component 74 at interior two step seal 78 and 80 and at exterior two step thread 82 and 84. In between lies an annular chamber 86 that communicates to the top of all the rod piston bores 72. Pressure applied through hydraulic connection 88 to which is connected a control line from the surface (not shown) pushes on pistons 70 at their upper seal 90. Piston 70 extends through a stationary seal 92 and is connected at end 94 to a slide 96. As shown in FIG. 6 ball 98 is in a stationary frame 100 and is able to rotate in place about fixed axis 102. Slide 96 is connected to ball 98 in an offset location from the central pivot axis 102. The movement of the slide 96 rotates the ball 98 preferably 90 degrees between the closed position shown and the open position. Actuation of the pistons 70 moves the slide 96 in opposed directions to open and close the passage 104. Frame 100 holds opposed sleeves 106 and 108 fast against the ball 98 to hold the sealing surfaces 110 and 112 against the ball 98. Seals 114 and 116 seal the exterior of sleeves 106 and 108 respectively so that with ball 98 in the FIG. 6 position, there is no leakage past ball 98.

Referring back to FIG. 3, housing component 76 has a second control line connection 118 to which another control line from the surface (not shown) is connected. Connection 118 leads to a radial passage 120 that communicates with an annular space 122 between the sleeve 106 and the inner wall 124 of housing components 74 and 76. The annular space 122 is defined between seal 126 barely seen in FIG. 3 but better seen in FIG. 6 at the upper end and seal 114 at the lower end. In between seals 114 and 126 there are radial passages leading from the annular space 122 to each piston bore 72 but on the opposite side of piston seal 90 than hydraulic fluid from connection 88.

Figure 1:
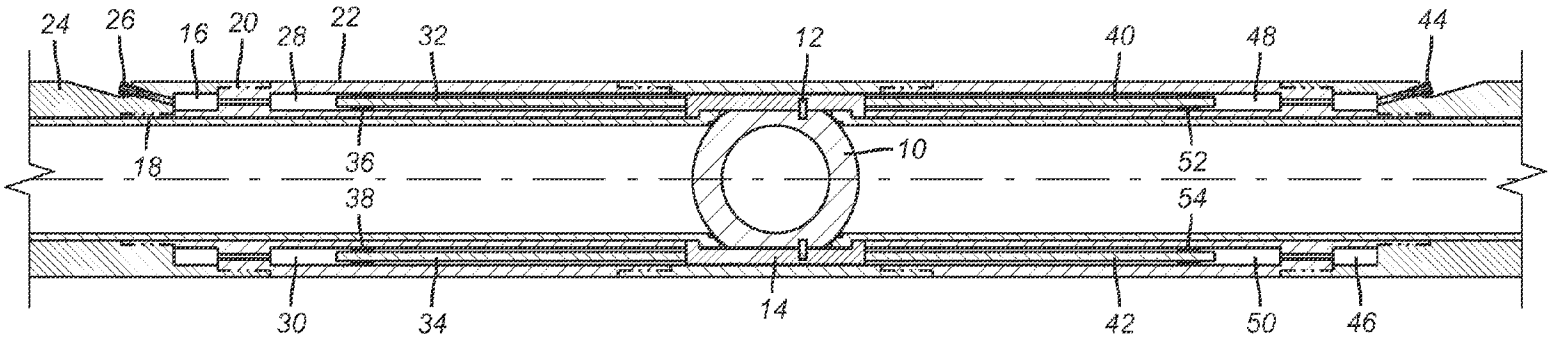
(PRIOR ART) FIG. 1
FIG. 1 illustrates a control system using opposed single acting pistons that can turn a ball between an open and a closed position.
Figure 2:
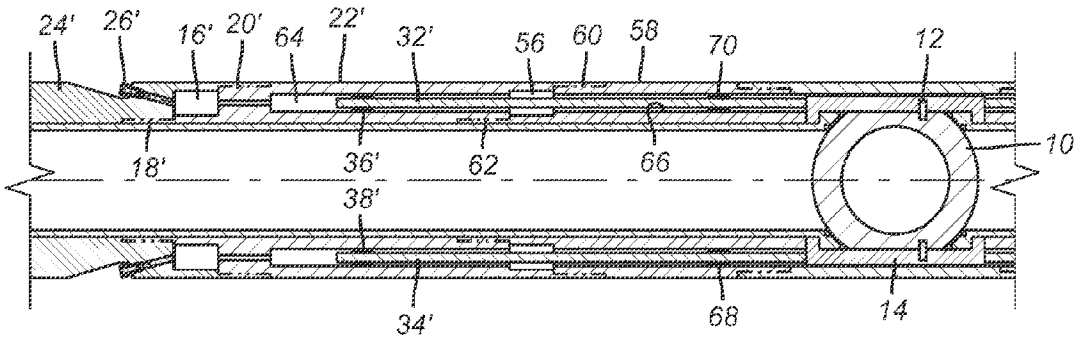
(PRIOR ART) FIG. 2
FIG. 2 illustrates the problem with making rod pistons double acting by illustrating that a second annular cavity requires a second housing joint so that a single piston bore is in adjacent housing joints making piston bore alignment very difficult.
Figure 5:
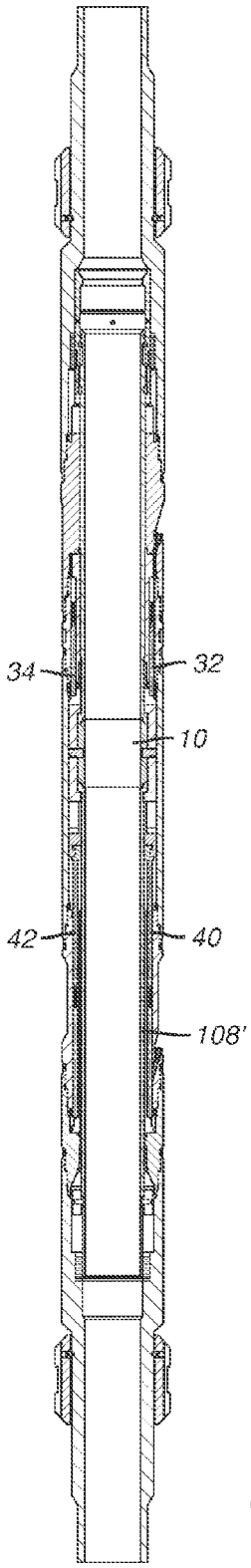
(PRIOR ART) FIG. 5
FIG. 5 is the view of FIG. 1 showing more details of the downhole isolation valve equipped with opposed single acting pistons.

Those skilled in the art will now clearly see that the rod piston bores 72 are in a single housing component 74 to remove the alignment issues discussed in connection with FIG. 2. Each rod piston 70 is double acting within the confines of a single housing component 74. What makes all this possible is the use of an annular internal passage 122 around sleeve 106 that provides access to each of the piston bores 72 on the back side of the piston 70 provided by a series of radial holes 128 leading into the piston bore 72 on the opposite side of the piston seal 90. As a result, the overall length of a given tool can be substantially shortened as can be seen by comparing FIGS. 5 and 6. In FIG. 6 with all the rod pistons 70 located above the ball 98 the lower sleeve 108 is considerably shorter than its counterpart 108' in FIG. 5 using opposed single acting pistons 32 and 34 above ball 10 and opposed pistons 40 and 42 below ball 10. In essence the sleeve 108 in FIG. 6 no longer has to straddle a set of pistons that are no longer there and can as a result be made much shorter. The overall tool length can also be shorter.

A variety of tools that operate downhole with control lines can benefit from double acting rod pistons while reducing the overall length. Such tools can include subsurface valves, sliding sleeves, ported sub or any other tool where opposed movement is used for its operating positions. In essence, the present invention allows for the creation of an internal annular space adjacent to a housing component that has a rod piston and takes advantage of that annular space to get access to all rod piston bores by simply providing radially drilled passages into the piston bores on a side opposite of a piston seal and in the same piston bore. A simple solution allows the piston bore to be in a single housing component and still permit a double acting capability to shorten overall tool length.

The above description is illustrative of the preferred embodiment and many modifications may be made by those skilled in the art without departing from the invention whose scope is to be determined from the literal and equivalent scope of the claims below.

We claim:

1. A control system for a subterranean tool, comprising:

a multi-component housing having a passage therethrough and a movable member in said passage;

at least one hydraulically actuated double acting rod piston in a piston bore in a wall of said housing, said bore having exterior housing connections communicating said bore to opposed sides of said piston and operably connected to said movable member for selective opening and closing of said passage with pressure from a surface location applied to said connections;

said piston bore fully disposed in the wall of a single component of said housing.

2. The system of claim 1, wherein:

said piston comprises a seal that divides said piston bore into a first and a second variable volume components;

access into one of said volume components is through said single component of said housing.

3. The system of claim 1, wherein:

said at least one hydraulically actuated double acting piston comprises a plurality of pistons each in its own bore where all said piston bores are in a wall of the single component of said housing.

4. A control system for a subterranean tool, comprising:

a multi-component housing having a movable member therein;

at least one hydraulically actuated double acting rod piston in a piston bore in said housing and connected to said movable member;

said piston bore fully disposed in a single component of said housing;

said piston comprises a seal that divides said piston bore into a first and a second variable volume components;

access into one of said volume components is through said single component of said housing;

said housing comprises a passage therein with a sleeve disposed therein to define an annular space therebetween;

said annular space leading to a passage through said single component and into one of said variable volume components of said piston bore.

5. The system of claim 4, wherein:

said housing comprises a first hydraulic connection leading to an annular space in a wall of said housing and communicating with said first variable volume component of said piston bore.

6. The system of claim 5, wherein:

said housing comprises a second hydraulic connection leading to said annular space defined by said sleeve and to said second variable volume component of said piston bore.

7. The system of claim 6, wherein:

said single housing component contains a radial passage connecting said annular space to said second variable volume component of said piston bore.

8. The system of claim 7, wherein:

said annular space comprises opposed end seals to communicate pressure applied to said second hydraulic connection through said annular space and said radial passage and into said second variable volume component of said piston bore.

9. A control system for a subterranean tool, comprising:

a multi-component housing having a passage therethrough and a movable member in said passage;

at least one hydraulically actuated double acting rod piston in a piston bore in a wall of said housing and operably connected to said movable member for selective opening and closing of said passage;

said piston bore fully disposed in the wall of a single component of said housing;

said movable member is a slide that operates a ball between an open and a closed position in a passage in said housing.

10. A control system for a subterranean tool, comprising:

a multi-component housing having a movable member therein;

at least one hydraulically actuated double acting rod piston in a piston bore in said housing and connected to said movable member;

said piston bore fully disposed in a single component of said housing;

said at least one hydraulically actuated double acting piston comprises a plurality of pistons each in its own bore where all said piston bores are in a wall of the single component of said housing;

all said piston bores are in fluid communication on a first side of the respective pistons in said bores through a first connection on the exterior of said housing;

all said piston bores are in fluid communication on a second side of the respective pistons in said bores through a second connection on the exterior of said housing.

11. The system of claim 10, wherein:

said first and second connections are in an adjacent housing component to said single component that houses said piston bores.

12. The system of claim 11, wherein:

said first connection in communication with an annular chamber defined between said single and adjacent housing components that is also in fluid communication with a first side of all said pistons in said piston bores.

13. The system of claim 12, wherein:

said second connection communicating with a sealed passage in said housing that leads to said second side of all said pistons in said piston bores.

14. The system of claim 13, wherein:

said sealed passage is an annular passage defined between a sleeve in a bore in said single and adjacent housing components.

15. The system of claim 14, wherein:

said single housing component comprises a bore from said sealed passage to each of said second sides of said pistons in said piston bores.

16. A control system for a subterranean tool, comprising:

a multi-component housing having a movable member therein;

at least one hydraulically actuated double acting rod piston in a piston bore in said housing and connected to said movable member;

said piston bore fully disposed in a single component of said housing;

said at least one hydraulically actuated double acting piston comprises a plurality of pistons each in its own bore where all said piston bores are in a wall of the single component of said housing;

all said piston bores are disposed parallel to each other in the wall of said single housing component.

* * * * *